US005575170A

United States Patent [19]

Stodd

[11] Patent Number: 5,575,170

[45] **Date of Patent: *Nov. 19, 1996**

[54] TOOLING APPARATUS AND METHOD FOR HIGH SPEED PRODUCTION OF DRAWN METAL CUP-LIKE ARTICLES

[76] Inventor: Ralph P. Stodd, 6450 Poe Ave., Suite 213, Dayton, Ohio 45414

[ * ] Notice: The term of this patent shall not extend beyond the expiration date of Pat. No. 5,442,947.

[21] Appl. No.: 516,555

[22] Filed: Aug. 18, 1995

Related U.S. Application Data

[63] Continuation of Ser. No. 184,969, Jan. 21, 1994, Pat. No. 5,442,947, which is a continuation-in-part of Ser. No. 30,777, Mar. 12, 1993, abandoned.

[51] Int. Cl.[6] ..... B21D 28/02

[52] U.S. Cl. ..... 72/336; 72/351; 72/404

[58] Field of Search ..... 72/336, 347–351, 72/339, 329, 404, 405

[56] References Cited

U.S. PATENT DOCUMENTS

| | | | |
|---|---|---|---|
| 3,115,678 | 12/1963 | Keen | 72/350 |
| 3,194,047 | 7/1965 | Eggert | 72/349 |
| 3,196,817 | 7/1965 | Fraze | 29/430 |
| 3,251,319 | 5/1966 | Kaupert | 72/349 |
| 3,557,599 | 1/1971 | Eickenhorst | 72/404 |
| 3,695,088 | 10/1972 | Alvi | 72/405 |
| 3,924,437 | 12/1975 | Hortig | 72/349 |
| 4,020,670 | 5/1977 | Bulso | 72/349 |
| 4,248,076 | 2/1981 | Bulso | 72/349 |
| 4,416,140 | 11/1983 | Bulso | 72/347 |
| 4,471,644 | 9/1984 | Kimbell | 72/455 |
| 4,550,588 | 11/1985 | Abe | 72/404 |
| 5,069,057 | 12/1991 | Lee | 72/452 |

FOREIGN PATENT DOCUMENTS

| | | | |
|---|---|---|---|
| 282731 | 12/1987 | Japan | 72/348 |

*Primary Examiner*—Daniel C. Crane
*Attorney, Agent, or Firm*—Jacox, Meckstroth & Jenkins

[57] ABSTRACT

The dynamic loading on a double action high speed mechanical cupping press is substantially reduced with multiple stage tooling which forms a batch of cups from a strip of sheet metal with each stroke of the press. Each tooling stage includes a plurality of annular draw pads each opposing a corresponding annular blank and draw die. An annular cut edge surrounds each of the draw pads, and a corresponding die center punch is located within each of the draw pads. The tooling stages are positioned at predetermined stepped elevations so that they sequentially blank the sheet metal to form a series of circular disk-like blanks between the cut edges and the corresponding blank and draw dies, sequentially hold the blanks between the draw pads and corresponding blank and draw dies, and sequentially draw the blanks into cups with the die center punches extending into the corresponding blank and draw dies. The tooling stages are symmetrically positioned with respect to the press center line.

10 Claims, 3 Drawing Sheets

FIG-5
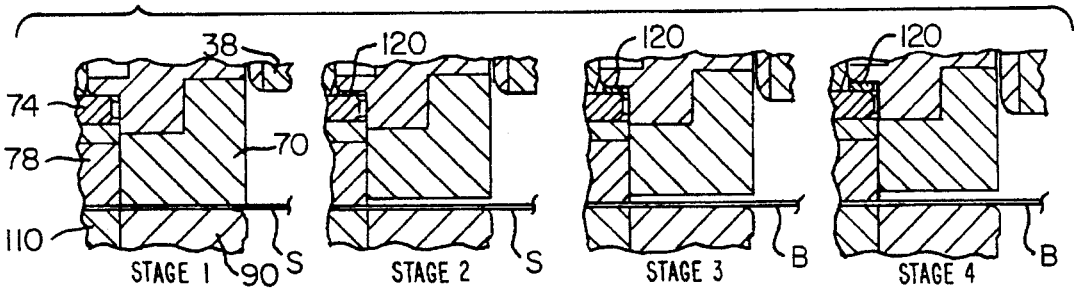
FIG-6
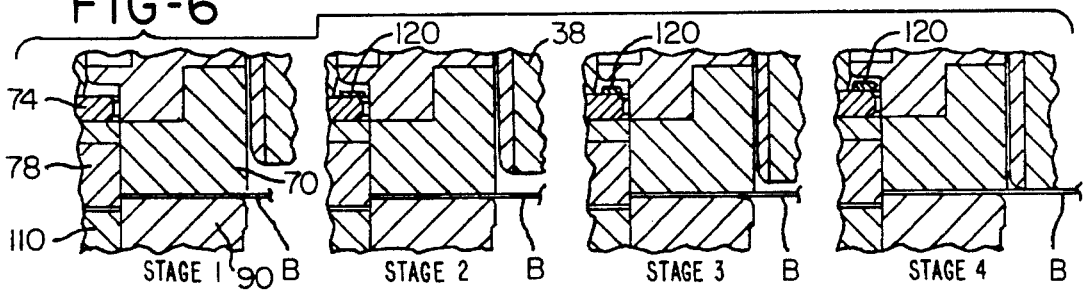
FIG-7
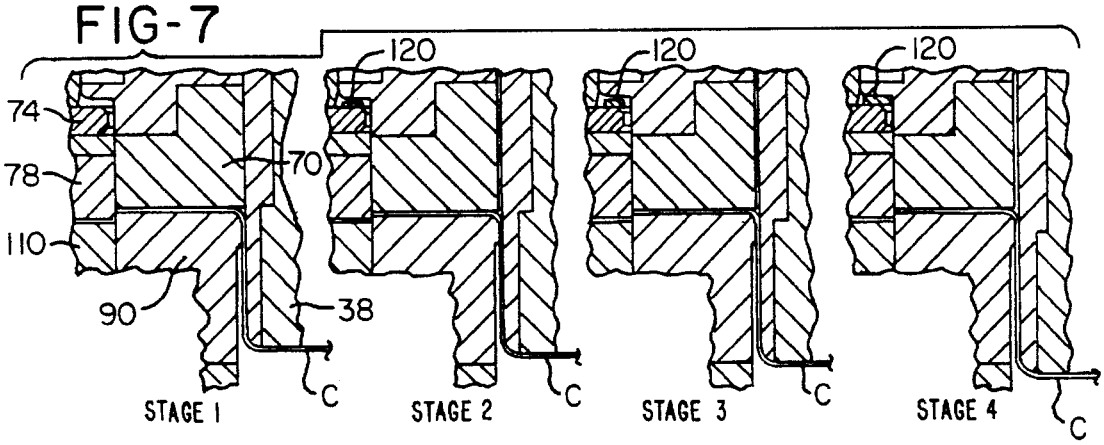
FIG-8
| DESCRIPTION | STAGE 1 | STAGE 2 | STAGE 3 | STAGE 4 |
|---|---|---|---|---|
| POCKETS | 1, 2, 13 & 14 | 3, 4, 11 & 12 | 5, 6, 9 & 10 | 7 & 8 |
| BLANK & DRAW RETAINERS | DOWN .012" | DOWN .012" | EVEN | EVEN |
| DRAW PAD SHIMS 120 | EVEN | UP .020" | UP .052" | UP .072" |
| UPPER PISTON SHIMS 121 | EVEN | UP .020" | UP .052" | UP .072" |
| DIE CENTER PUNCH SHIMS 122 | EVEN | DOWN .060" | DOWN .116" | DOWN .198 |

TOOLING APPARATUS AND METHOD FOR HIGH SPEED PRODUCTION OF DRAWN METAL CUP-LIKE ARTICLES

RELATED APPLICATION

This application is a continuation of application Ser. No. 08/184,969, filed Jan. 21, 1994, U.S. Pat. No. 5,442,947, which is a continuation-in-part of application Ser. No. 08/030,777, filed Mar. 12, 1993, abandoned.

BACKGROUND OF THE INVENTION

In the production of cups or cans in the can industry, it is common to use a double action mechanical press equipped with cupping tooling, for example, of the general type disclosed in U.S. Pat. No. 4,020,670, U.S. Pat. No. 4,248,076 and U.S. Pat. No. 4,416,140. Such cupping presses commonly operate within a range of 150 to 200 strokes per minute (spm) and have a plurality of cup-forming tooling components in order to produce a batch of cups with each stroke of the press.

It has been found desirable to operate such a cupping press at a higher speed, for example, within a range of 220 to 250 spm, in order to meet the increase in product ion requirements in the can industry. However, such a substantial increase in the speed of the cupping press significantly increases the dynamic loading on the press, and especially the compressive and tensile loads on the outer ram of the double action press. This increase in dynamic loading on the press can result in the press exceeding its rated loading and failure of the press components.

It is known in the tool and die industry to construct punch and die tooling for blanking or cutting a plurality of parts from a sheet metal workpiece with each stroke of the press and by positioning each punch at a slightly different elevation corresponding to the thickness of the sheet metal workpiece. As a result, the blanking of the parts is performed in sequence, but the holding of the workpiece is performed by one plate without any sequence.

SUMMARY OF THE INVENTION

The present invention is directed to an improved method and apparatus for constructing and operating the tooling for a press for producing a plurality of cup-like articles with each stroke of the press and which provides for significantly increasing the operational speed of the press to obtain a higher production rate without overloading components of the press. For example, a cupping press equipped with tooling constructed in accordance with the present invention is capable of obtaining more than a 50% decrease in the compressive forces or loading on the outer ram and this decrease permits the speed of the press to be increased from about 150 spm to about 250 spm without exceeding the load rating of the press.

In accordance with one embodiment of the invention, a cupping press is equipped with multiple stage tooling wherein each tooling stage includes a plurality of annular draw pads each opposing a corresponding annular blank and draw die, an annular cut edge die surrounding each of the draw pads and a corresponding die center punch within each of the draw pads. The tooling stages are constructed for sequentially engaging the sheet metal with a precise timing sequence which provides for sequentially blanking a series of circular blanks between the cut edge dies and the corresponding blank and draw dies during each stroke of the press, sequentially holding the blanks between the draw pads and the corresponding blank and draw dies, and then sequentially drawing the blanks into cups with the die center punches extending into the corresponding blank and draw dies. Also in accordance with the invention, the tooling of an existing cupping press may be easily modified by installing a series of annular shims for some of the draw pads and the retainers for the cut edge dies and by lowering the retainers supporting some of the blank and draw dies. The present invention also provides for conveniently and quickly removing upper tooling components to simplify servicing of the tooling after an extended period of use.

Other features and advantages of the invention will be apparent from the following description, the accompanying drawings and the appended claims.

BRIEF DESCRIPTION OF THE DRAWINGS

FIG. 5–7 are enlarged fragmentary sections of the tooling components shown in FIGS. 2 & 3 and illustrating the sequential blanking, holding and drawing operations in accordance with invention; and FIG. 8 is a chart illustrating the relative positions of the multiple stage or stepped tooling components shown in and FIGS. 2 & 5–7.

DESCRIPTION OF THE PREFERRED EMBODIMENT

Figure 1:
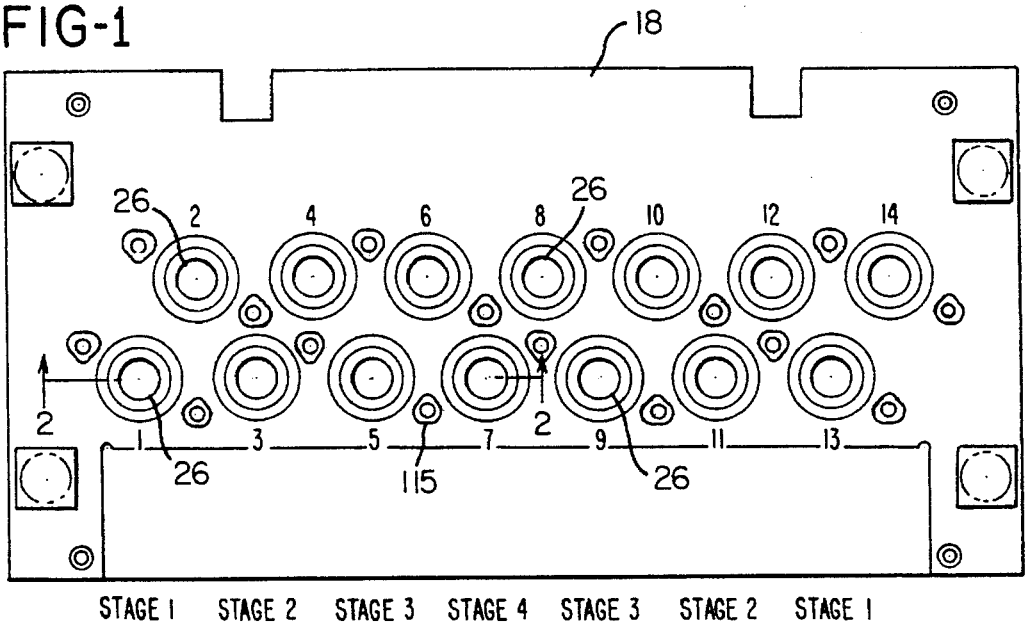
FIG. 1 is a general plan view of lower cup forming tooling constructed in accordance with the invention and with the stock plate removed.

FIG. 1 illustrates a plan view of the lower or bottom tooling of a fourteen cup tooling system 15 which includes a lower die shoe 18 secured to a bed 20 (FIG. 2) of a double action mechanical press. The press also includes an inner ram 22 and an outer ram 24, with the inner ram 22 having a vertical stroke, for example, of about five inches and the outer ram 24 having a substantially shorter stroke, for example, about two inches. As shown in FIG. 1, the lower die shoe 18 has a series of fourteen holes or pockets 26 which extend vertically or downwardly through the lower die shoe 18 to a cup discharge chamber 28. The pockets 26 are arranged in four stages (FIG. 1) with pockets 1, 2, 13 and 14 forming stage 1, pockets 3, 4, 11 and 12 forming stage 2, pockets 5, 6, 9 and 10 forming stage 3 and pockets 7 and 8 forming the center stage 4.

The inner ram 22 (FIG. 2) supports an upper or inner die shoe 32. A series of vertical risers 34 are secured to the bottom surface of the inner die shoe 32 and extend downwardly in vertical alignment with the corresponding pockets 26. A die center punch 38 (FIG. 3) is secured to the lower end portion of each riser 34 by a center screw 39 and a precision locator pin 41, and each die center punch 38 carries a hardened outer wear sleeve 42. Each of the risers 34 and the corresponding die center punch 38 have a vertically extending air passage 44 which receives a supply of pressurized air at timed intervals for removing cups from the punch. As apparent from FIG. 2, the risers 34 and corresponding die center punches 38 are carried by and move vertically with the inner ram 22 through the attached inner die shoe 32.

Figure 2:
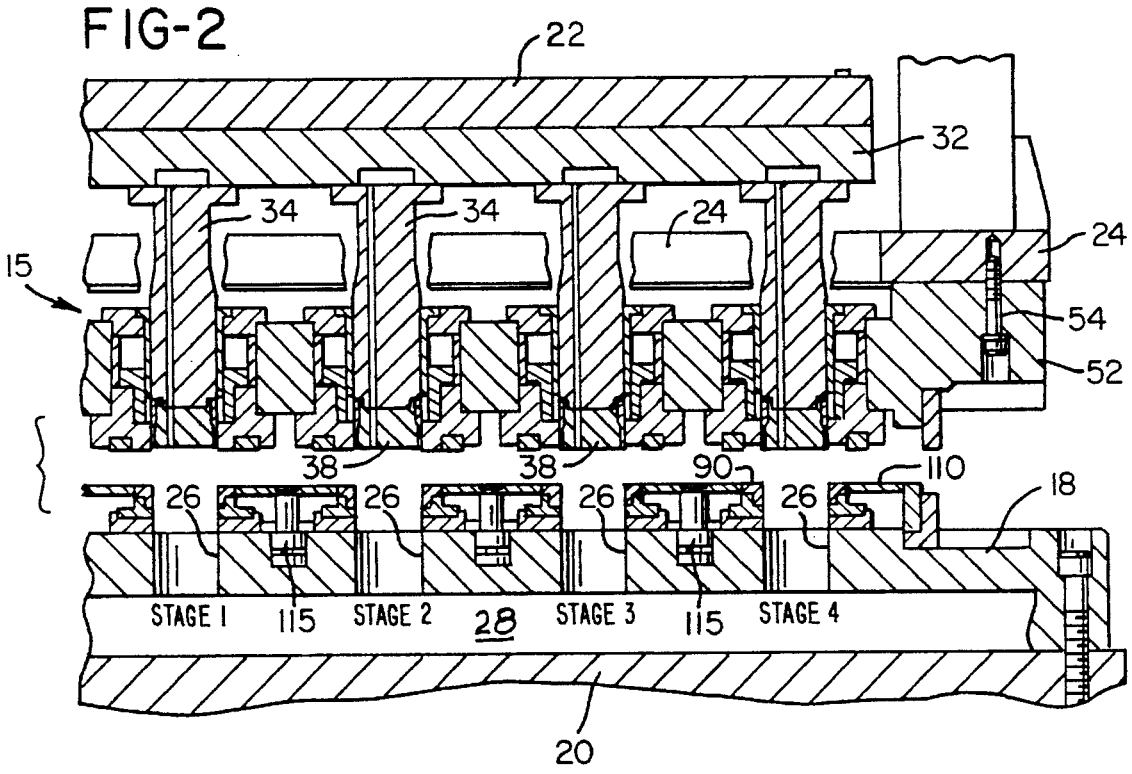
FIG. 2 is a fragmentary section of the upper and lower cup forming tooling in a double action press, and showing the multiple stages of the tooling as taken generally on the line 2—2 of FIG. 1.
Figure 3:
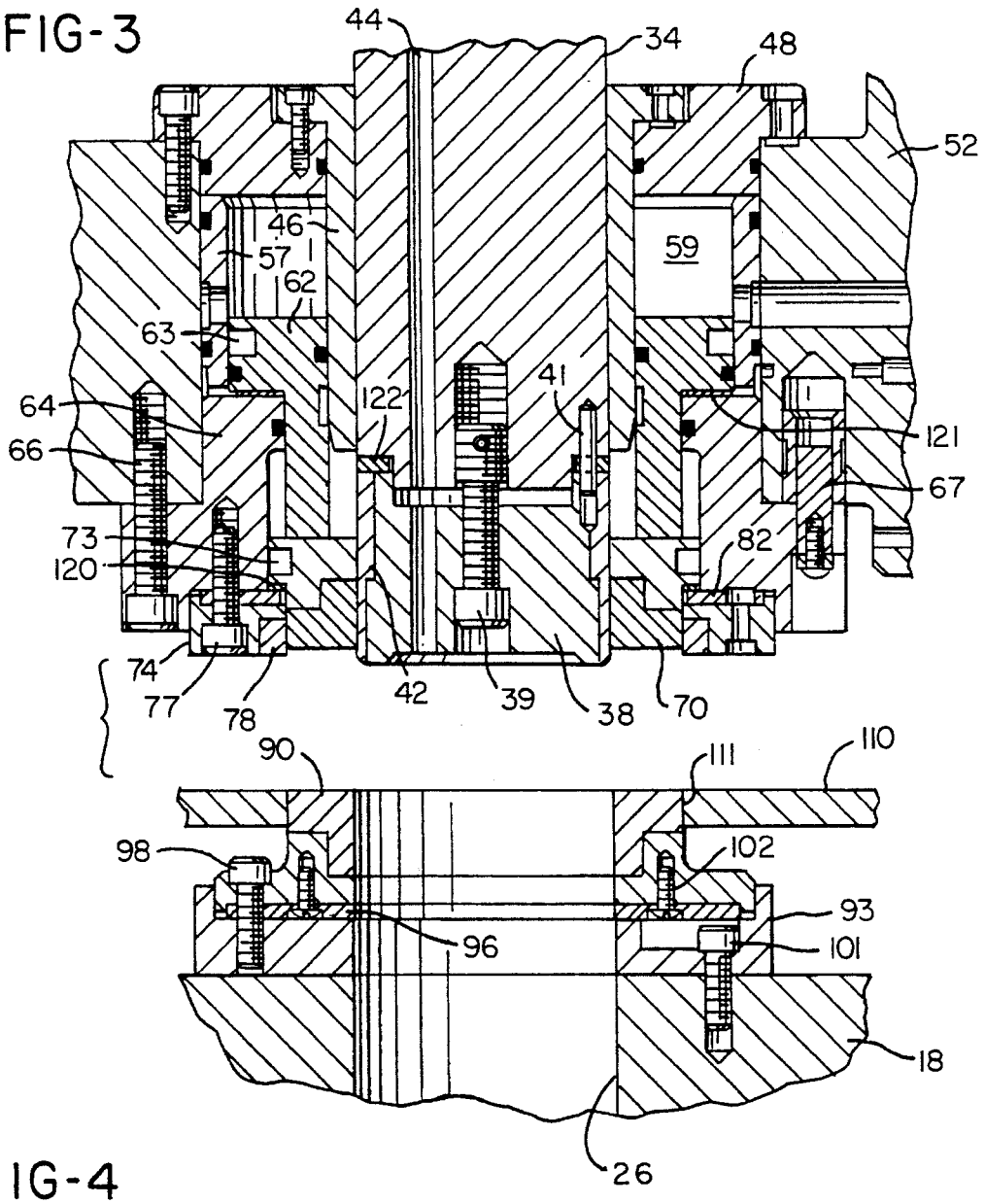
FIG. 3 is an enlarged fragmentary section of one of the tooling stages shown in FIG. 2.

Since the tooling components for each pocket 26 are substantially the same, only the components for one pocket are described in reference to FIG. 3. A cylindrical guide sleeve 46 (FIG. 3) surrounds each of the risers 34 and has an upper flange secured to an annular plate 48 which is mounted on an upper die shoe 52. The upper die shoe 52 is carried by the outer ram 24 through a series of peripherally spaced screws 54 (FIG. 2). A cylindrical liner 57 lines a bore within the upper die shoe 52 and cooperates with the sleeve 46 and plate 48 to define a fluid or air chamber 59 which receives the head portion of a piston 62. The head portion carries wear pads (not shown) within peripherally spaced holes 63 and is confined within the chamber 59 by an annular retainer 64 secured to the upper die shoe 52 by peripherally spaced screws 66 and a precision locator pin 67.

A two section draw pad 70 is supported for vertical sliding movement within the annular retainer 64 below the piston 62, and the bottom surface of the draw pad 70 has a series of fine concentric grooves or recesses to form an irregular surface. The lower portion of the draw pad 70 is formed from a harder steel than the upper portion which engages the piston 62 and carries wear pads (not shown) within peripherally spaced holes 73. The draw pad 70 is retained within the annular retainer 64 by an annular cut edge retainer 74 secured to the retainer 64 by a series of peripherally spaced screws 77. The retainer 74 supports a hardened annular shearing die or cut edge 78 which surrounds the draw pad 70. A hardened flat spacer ring 82 is recessed within the upper portion of the cut edge retainer 74 and forms a lower limit of movement for the draw pad 70.

As illustrated in FIG. 3, each of the holes or pockets 26 within the lower die shoe 18 is vertically aligned with the corresponding die center punch 38 and is slightly larger in diameter. Also vertically aligned with each of the pockets 26 within the lower die shoe 18 is a two section annular blank and draw die 90 which is supported in a circular recess of an annular retainer 93 by a flat annular spacer 96. Each blank and draw die 90 is secured to its corresponding retainer 93 by a set of peripherally spaced screws 98, and another set of screws 101 secures each retainer 93 to the lower die shoe 18. A set of screws 102 secures the spacer 96 to the blank and draw die 90. Locating pins and bushings (not shown) are also used to align each blank and draw die 90 and its retainer 93 precisely on the lower die shoe 18. As also shown in FIG. 3, the upper portion or section of the blank and draw die 90 consists of a hardened ring which is inserted and positively retained within the lower portion or section of the die 90.

Figure 4:
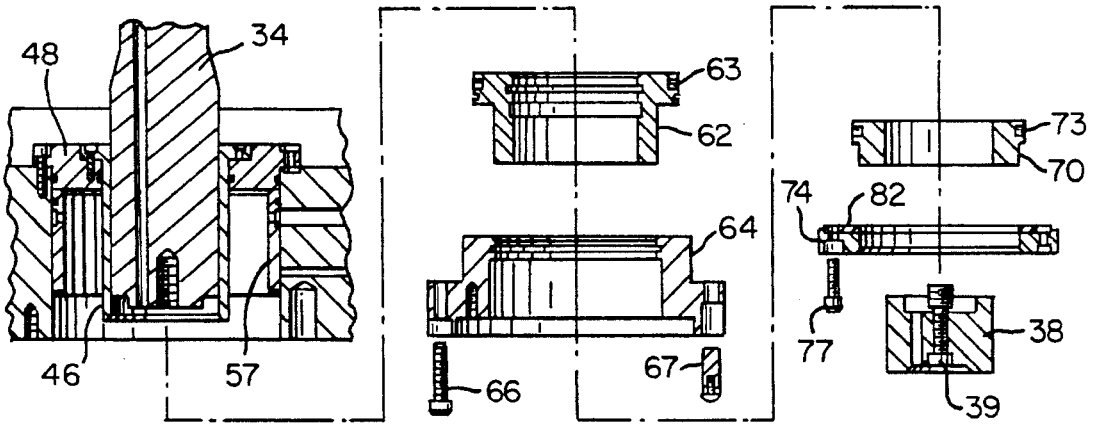
FIG. 4 is a fragmentary exploded view illustrating the assembly of upper tooling components shown in FIG. 3.

Referring to FIG. 4, the die center punch 38, draw pad 70, surrounding cut edge retainer 74 and cut edge 78, piston 62 and piston retainer 64, which form part of the upper tooling on the upper die shoe 52, may be conveniently and quickly removed from the die shoe 52, simply by removing the screws 39, 66 and 77. Furthermore, these components may be removed for replacing components such as wear pads or piston sealing rings without further elevation of the upper die shoe 52 or without further disassembly of the upper tooling.

Referring to FIGS. 2 and 3, a flat stock plate 110 forms part of the bottom or lower tooling and defines a circular opening or clearance hole 111 for receiving each of the blank and draw dies 90. The stock plate 110 is supported with its upper surface generally flush with the upper surface of the blank and draw dies 90 by a series of spring biased pistons 115 (FIG. 2) which are located within the lower die shoe 18 between and around the blank and draw dies 90, as shown in FIG. 1. The spring loaded pistons 115 biased the stock plate 110 to its elevated position (FIGS. 2 and 3) with a predetermined force, but permit the stock plate 110 to move downwardly by a fraction of an inch when the force is exceeded by the downward movement of the cut edges 78 and retainers 74.

Referring to FIGS. 5–8, the multiple stage tooling described above in connection with FIGS. 1–4, operates to perform sequential blanking, holding and drawing operations with respect to sets of the holes or pockets 26. These sequential operations are performed by precisely positioning each stage of the blank,and draw dies 90, the draw pads 70 and the die center punches 38 at predetermined elevations relative to the press bed 20. For example, existing cupping tooling may be modified by grinding the bottom surfaces of some of the blank and draw die retainers 93 to lower the blank and draw dies, and by adding a set of shims to the upper tooling for each of the stages 2, 3 and 4.

Referring to FIG. 3, which illustrates stage 4 of the tooling shown in FIGS. 1 and 2, a flat annular shim 120 limits the downward movement of each draw pad 70 relative to its surrounding cut edge 78, and an annular flat shim 121 limits the downward movement of the corresponding air actuated piston 62 which presses downwardly with a predetermined pressure on the draw pad 70. Another annular flat shim 122 spaces or lowers each of some of the die center punches 38 with respect to its supporting riser 34 and precisely determines the elevation of the die center punch with respect to its surrounding draw pad 70.

As shown, for example, in the chart of FIG. 8, the blank and draw dies 90 for the holes of stages 1 and 2 are each lowered by 0.012 inch. This lowering is accomplished by grinding the bottom surfaces of the retainers 93 supporting the corresponding blank and draw dies 90. The shims 120 and 121 for the stage 2 pockets 3, 4, 11 and 12 have a thickness of 0.020 inch so that the pistons 62 for the pockets of stage 2 and the corresponding draw pads 70 are elevated by 0.020 inch above the pistons 62 and draw pads 70 for the stage 1 pockets 1, 2, 13 and 14. The die center shims 122 for the stage 2 pockets 3, 4, 11 and 12 have a thickness of 0.060 inch so that the die center punches 38 for these pockets are lowered by 0.060 inch relative to the die center punches for the stage 1 pockets.

As also apparent from the chart of FIG. 8, the shims 120 and 121 for the stage 3 pockets 5, 6, 9 and 10 have a thickness of 0.052 inch so that the pistons 62 and draw pads 70 for these pockets are elevated by 0.040 inch above the draw pads 70 for the stage 2 pockets. The die center punch shims 122 for the stage 3 pockets have a thickness of 0.116 inch so that the die center punches 38 for these pockets are 0.056 inch lower than the die center punches for the stage 2 pockets. Similarly, the shims 120 and 121 for the stage 4 pockets 7 and 8 have thickness of 0.072 inch, and the die center punch shims 122 for these pockets have a thickness 0.198 inch so that the draw pads for these pockets are elevated by 0.020 inch above the draw pads 70 for the stage 3 pockets, and the die center punches 38 for the stage 4 pockets are 0.082 inch lower than the die center punches 38 for the stage 3 pockets.

Referring to FIGS. 5–7, a sheet S of metal, such as 0.011 inch thick aluminum, is fed between the upper tooling and lower tooling in the downward direction in FIG. 1. The downward movement of the outer ram 24 and the upper die shoe 52 causes the sheet S to be sequentially sheared or blanked between the annular cut edges 78 and the annular blank and draw dies 90 for the stages 1–4 for progressively forming the flat circular blanks B. As apparent from FIG. 5, the blanks B are sequentially clamped or held against the blank and draw dies 90 by the draw pads 70 for the stages 1–4 as a result of the shims 120 and 121 with increasing thickness. As apparent from FIGS. 6 and 7, the downward movement of the inner ram 22 and inner die shoe 32 causes the die center punches 38 for the stages 1–4 to engage the blanks B sequentially and to draw the blanks sequentially into corresponding cups C. As shown in FIG. 7, the increasing thickness of the shims 122 above the die center punches 38 for stages 1–4, results in the cups C being sequentially drawn in a reverse order, with the cups C for stage 4 being fully drawn prior to the cups for stage 3 being fully drawn and prior to the cups for stage 2 being fully drawn prior to the cups at stage 1.

From the drawings and the above description, it is apparent that a mechanical cupping press equipped with tooling constructed in accordance with the present invention, provides desirable features and advantages. As one important feature, by sequentially gripping or holding the blanks B between the draw pads 70 and the blank and draw dies 90 for the stages 1–4, the dynamic loading on the outer ram 24 is substantially reduced. For example, the compressive load of 98 tons on the outer ram of a 150 ton press with eight pocket tooling operating at 250 spm, is reduced to a compressive load of 48 tons with tooling constructed in accordance with the present invention. This represents a compressive load reduction on the outer ram of over 50% and thus permits substantially increasing the speed of the press without overloading the press. While the sequential holding of the blanks B provides the greatest reduction in the loading on the press, the sequential blanking of the sheet S to form the flat circular blanks B also decreases the compressive loading on the outer ram of the double action press, and the sequential drawing of the blanks B into the cups C further reduces the loading on the inner ram 22. It is also apparent that the sequencing of the tooling also reduces the maximum tensile loading on the press components during the instant when the rams reverse their directions at the bottom of their strokes.

While the invention is illustrated by the use of shims 120, 121 and 122 to perform the sequential blanking, holding and drawing operations with existing cupper tooling, it is apparent that new cupper tooling may be constructed with dimensions which eliminate the need for the shims 120–122. Furthermore, while the chart of FIG. 8 illustrates a stepping sequence for a fourteen cup or pocket tooling, the step differentiation for the stages 1–4 may be modified according to the number of stages, the number of pockets, the type of tooling and the type of mechanical press. Also, the term cup-like articles, as used herein, includes a plurality of any drawn sheet metal articles each of which has a bottom wall integrally connected to an upwardly projecting annular wall.

While the method and form of apparatus herein described constitute a preferred embodiment of the invention, it is to be understood that the invention is not limited to the precise method and form of apparatus described, and that changes may be made therein without departing from the scope and spirit of the invention as defined in the appended claims.

The invention having thus been described, the following is claimed:

1. A method of forming a batch of cup-like articles from a strip of sheet metal with each stroke of a high speed mechanical press and for significantly reducing the dynamic loading on the press during each stroke of the press, the tooling comprising a series of cup-forming stages each including at least one annular draw pad opposing a corresponding annular blank and draw die, an annular cut edge die surrounding each of the draw pads and a die center punch within each of the draw pads, the method comprising the steps of engaging the strip with the annular cut edge dies and the corresponding blank and draw dies of the stages for forming a series of generally circular disk-like blanks, inserting a series of shims of different thicknesses for positioning the draw pads of the stages to provide for sequentially engaging the metal on the blank and draw dies with the draw pads of the stages for sequentially holding the metal with each stroke of the press, and engaging the center portions of the blanks being held by the draw pads with the corresponding series of die center punches of the stages for drawing the blanks into the articles with each stroke of the press.

2. A method of forming a batch of cup-like articles from a strip of sheet metal with each stroke of a high speed mechanical press and for significantly reducing the dynamic loading on the press during each stroke of the press, the tooling comprising a series of cup-forming stages each including at least one annular draw pad opposing a corresponding annular blank and draw die, an annular cut edge die surrounding each of the draw pads and a die center punch within each of the draw pads, the method comprising the steps of engaging the strip with the annular cut edge dies and the corresponding blank and draw dies of the stages for forming a series of generally circular disk-like blanks, engaging the metal on the blank and draw dies with the draw pads of the stages for holding the metal with each stroke of the press, and inserting a series of shims of different thickness for positioning the die center punches to provide for sequentially engaging the center portions of the blanks being held by the draw pads with the corresponding series of die center punches of the stages for sequentially drawing the blanks into the articles with each stroke of the press.

3. A method of substantially simultaneously producing a series of cup-like articles from a strip of sheet metal with tooling mounted on a double action mechanical press including an inner ram and an outer ram each supported for reciprocating movement, the tooling comprising a series of horizontally spaced and substantially identical cup-forming stages each including an annular draw pad movable with the outer ram, an annular blank and draw die opposing the annular draw pad at each stage, an annular cut edge die surrounding the draw pad at each stage and movable with the outer ram, and a die center punch within the draw pad at each stage and movable with the inner ram, the method comprising the steps of engaging the strip between the annular cut edge dies and the corresponding annular blank and draw dies at all of the stages for forming a series of generally circular disk-like blanks, holding the metal between the annular draw pads and the corresponding annular blank and draw dies at the stages, and positioning the corresponding die center punches and annular blank and draw dies with slightly different spacing at each stage for sequentially engaging the blanks being held between the draw pads and the blank and draw dies with the corresponding die center punches for sequentially drawing the blanks into the cup-like articles, for significantly reducing the compressive and tensile loading on the press during each stroke of the outer ram.

4. A method as defined in claim 3 wherein the strip is sequentially engaged by the annular cut edge dies and the corresponding annular blank and draw dies at the stages for sequentially forming the generally circular disk-like blanks.

5. A method of substantially simultaneously producing a series of cup-like articles from a strip of sheet metal with tooling mounted on a double action mechanical press including an inner ram and an outer ram each supported for reciprocating movement, the tooling comprising a series of horizontally spaced and substantially identical cup-forming stages each including an annular draw pad movable with the outer ram, an annular blank and draw die opposing the annular draw pad at each stage, an annular cut edge die surrounding the draw pad at each stage and movable with the outer ram, and a die center punch within the draw pad at each stage and movable with the inner ram, the method comprising the steps of engaging the strip between the annular cut edge dies and the corresponding annular blank and draw dies at all of the stages for forming a series of generally circular disk-like blanks, sequentially holding the metal between the annular draw pads and the corresponding annular blank and draw dies at the stages, and sequentially engaging the center portions of the blanks being held between the draw pads and the blank and draw dies with the corresponding die center punches for sequentially drawing the blanks into the cup-like articles, for significantly reducing the compressive and tensile loading on the press during each stroke of the outer and inner rams.

6. A method as defined in claim 5 wherein the strip is sequentially engaged by the annular cut edge dies and the corresponding annular blank and draw dies at the stages for sequentially forming the generally circular disk-like blanks.

7. Tooling apparatus for use on a double action mechanical press including an inner ram and an outer ram each supported for reciprocating movement and for substantially simultaneously forming a series of cup-like articles from a strip of sheet metal with each reciprocating stroke of each ram, said tooling apparatus comprising a series of horizontally spaced and substantially identical cup-forming stages each including an annular draw pad, a fluid cylinder and piston between each of said draw pads and said outer ram to provide for movement of said draw pad relative to said outer ram in response to predetermined pressure, a corresponding annular blank and draw die opposing each of said draw pads at each of said stages, an annular cut edge die surrounding each of said draw pads and connected to move with said outer ram, a die center punch within each of said draw pads and connected to move with said inner ram, said annular cut edge dies and the corresponding said blank and draw dies at said stages cooperating to form a corresponding series of generally circular disk-like blanks with each stroke of said outer ram, the corresponding said blank and draw dies and opposing said draw pads having opposing surfaces with slightly different spacing therebetween at each stage for sequentially holding the metal between said draw pads and said blank and draw dies at said stages with each stroke of said outer ram for significantly reducing the compressive and tensile loading on the press during each stroke of said outer ram, and said die center punches cooperating with the corresponding said blank and draw dies at said stages for drawing the blanks into the articles with each stroke of said inner ram.

8. Tooling apparatus for use on a double action mechanical press including an inner ram and an outer ram each supported for reciprocating movement and for substantially simultaneously forming a series of cup-like articles from a strip of sheet metal with each reciprocating stroke of each ram, said tooling apparatus comprising a series of horizontally spaced and substantially identical cup-forming stages each having cup-forming tooling components including an annular draw pad, means connecting each of said draw pads to said outer ram and providing for movement of said-draw pad relative to said outer ram in response to predetermined pressure, a corresponding annular blank and draw die opposing each of said draw pads at each of said stages, an annular cut edge die surrounding each of said draw pads and connected to move with said outer ram, a die center punch within each of said draw pads and connected to move with said inner ram, said annular cut edge dies and the corresponding said blank and draw dies at said stages cooperating to form a corresponding series of generally circular disk-like blanks with each stroke of said outer ram, said blank and draw dies-and the opposing said draw pads cooperating to hold the metal between said draw pads and said blank and draw dies at said stages with each stroke of said outer ram, and said die center punches and the corresponding said blank and draw dies having opposing surfaces with slightly different spacing at each said stage for sequentially drawing the blanks into the articles with each stroke of said inner ram, for significantly reducing the compressive and tensile loading on the press during each stroke of said rams.

9. Apparatus as defined in claim 8 wherein each of said cup-forming stages includes a plurality of said cup-forming tooling components, and said components for each stage are symmetrically positioned with respect to a center plane of the press.

10. Apparatus as defined in claim 8 wherein the corresponding said cut edge dies and said blank and draw dies have opposing surfaces with slightly different spacing at each stage for sequentially forming the series of blanks with each stroke of said outer ram.

* * * * *